United States Patent [19]

Schmid

[11] Patent Number: 4,836,567

[45] Date of Patent: Jun. 6, 1989

[54] ROLLER SKIS

[76] Inventor: Engelbert Schmid, Seitenstr. 2, Gelsenkirchen-Buer, Fed. Rep. of Germany

[21] Appl. No.: 155,724

[22] PCT Filed: May 9, 1987

[86] PCT No.: PCT/EP87/00245

§ 371 Date: Jan. 19, 1988

§ 102(e) Date: Jan. 19, 1988

[87] PCT Pub. No.: WO87/07169

PCT Pub. Date: Dec. 3, 1987

[30] Foreign Application Priority Data

May 22, 1986 [DE] Fed. Rep. of Germany ..... 3617245

[51] Int. Cl.[4] ..... A63C 17/04

[52] U.S. Cl. ..... 280/842; 188/2 R; 188/71.7; 188/80; 280/11.2; 280/11.22; 280/87.041

[58] Field of Search ..... 280/11.1 BT, 11.1 BR, 280/11.1 R, 11.1 ET, 11.18, 11.2, 11.22, 11.28, 87.04 A, 87.04 R, 11.27; 188/71.7, 80, 2 R

[56] References Cited

U.S. PATENT DOCUMENTS

| | | | |
|---|---|---|---|
| 1,845,345 | 2/1932 | Sauzedde | 188/2 R |
| 2,892,514 | 6/1959 | Gaines et al. | 280/63 |
| 3,767,220 | 10/1973 | Peterson | 280/11.2 |
| 3,790,187 | 2/1974 | Radu et al. | 280/11.21 |
| 3,876,217 | 1/1975 | Copier | 280/11.23 |
| 3,884,486 | 5/1975 | Wilje | 280/11.1 R |
| 4,273,345 | 6/1981 | Ben-Dor et al. | 280/11.2 |
| 4,460,187 | 7/1984 | Shimizu | 280/11.1 BT |

FOREIGN PATENT DOCUMENTS

| | | | |
|---|---|---|---|
| 2910670 | 10/1974 | Fed. Rep. of Germany . | |
| 2747294 | 4/1979 | Fed. Rep. of Germany | 280/11.2 |
| 3823152 | 12/1979 | Fed. Rep. of Germany . | |
| 2906725 | 9/1980 | Fed. Rep. of Germany . | |
| 2412433 | 10/1980 | Fed. Rep. of Germany . | |
| 2924778 | 2/1981 | Fed. Rep. of Germany BT | 280/11.1 |
| 2937391 | 4/1981 | Fed. Rep. of Germany . | |
| 1015536 | 10/1952 | France | 280/11.1 BT |
| 961728 | 9/1982 | U.S.S.R. | 280/11.1 BT |

*Primary Examiner*—Charles A. Marmor
*Assistant Examiner*—Eric Culbreth
*Attorney, Agent, or Firm*—Collard, Roe & Galgano

[57] ABSTRACT

The invention concerns a roller ski, each of which has a longitudinal support (1) equipped with a ski binding (5) to secure a ski boot, on which support (1), front and back, rubber-tired running wheels (3, 8, 9) are situated, one or more of which are provided with a return catch. In order to provide such roller skis with a braking device which is simple in design and construction and which can be operated by the skier by executing a movement of the body usually made during skiing, the invention provides for equipping, in particular, the rear running wheels (8), located on the side facing the adjacent roller ski with a brake lining (10) laterally mounted on the running wheel (8), which brake lining projects slightly inwardly above the inner lateral boundary (11) of the longitudinal support (1) which extends in the direction of movement. The invention further proposes providing these lateral boundaries (11) of the longitudinal supports (1) with counterbrake surfaces (12) which extend, essentially, in a direction parallel to the brake linings (10) on the running wheels (8).

3 Claims, 1 Drawing Sheet

ROLLER SKIS

Figure 1:
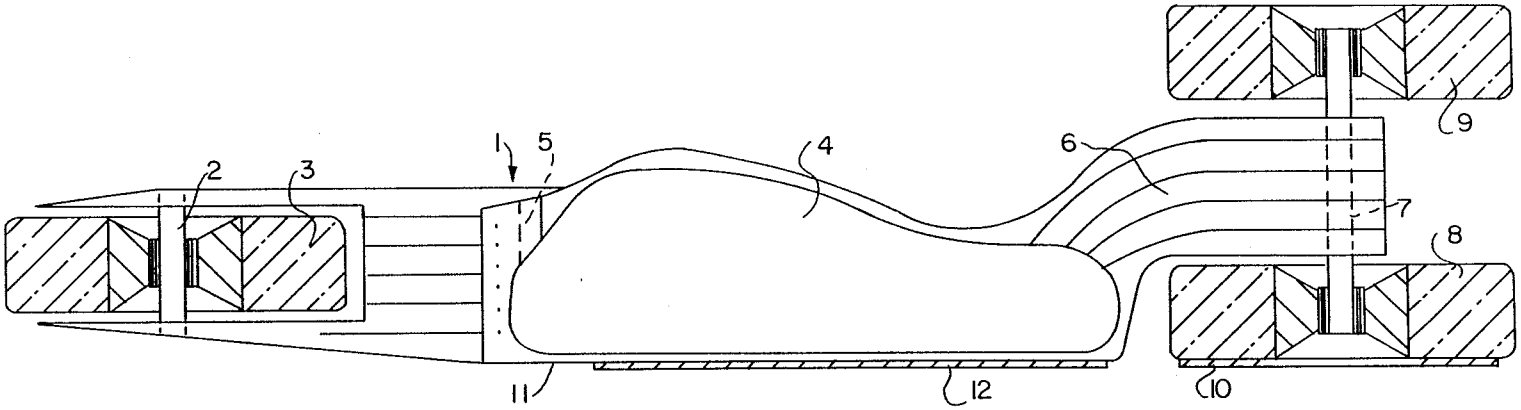

The invention concerns roller skis, each of which has a longitudinal support equipped with a binding for a ski boot, on which support, front and back, rubber-tired running wheels are situated, one or more of which are provided with a return catch.

Such roller skis are known in the art as a summer training device for cross-country skiers. In this instance, the rubber-tired running wheels have a relatively small diameter and are, accordingly, only appropriate for level, solid terrain, for example, for paved streets. In order to also be able to use such roller skis on surfaces other than paved roads, for example, on paths in the woods, the use of running wheels with a larger diameter is also known in the art. Roller skis outfitted in this manner are, by the very principle of their design, excellently suited for fitness training because, in contrast to downhill skiing, skiers' joints are subjected to less impact stress and, because of the movement of the arms with ski poles, the entire body is more involved in the fitness training exercise.

A particular problem encountered in using such roller skis is the ability to brake the roller skis on a downhill surface. The patent literature is replete with numerous proposals for braking devices which act upon the wheels, which devices are released with a ski pole, via a rope, by hand, with the skier's heel or calf. All these braking devices, however, are too complicated in design and construction and impede natural the skier's natural motional sequence, with the result that such roller skis have hardly found acceptance.

DE-OS No. 28 23 152 proposes a configuration whereby the support tilts about an axle running in the direction of movement and brake shoes that act upon the running wheels. This configuration is intended to make it possible to achieve a braking effect through tilting of the roller ski, that is, through a movement practiced even in normal skiing. This braking device, however, has the drawback that it produces undesired and unexpected braking action for the skier when he is on uneven terrain, when the terrain runs at a diagonal incline to the direction of travel, or correspondingly uneven surface conditions are present. Such undesired and, for the skier, unpredictable braking action can lead to unpleasant falls.

The task, therefore, of the invention is to further develop the roller skis of the kind described at the outset in such a way that they can be braked, as desired and without the use of a complicated braking device, through a movement known to the skier on downhill terrain.

In solving this task, the invention, taking the roller skis of the kind described at the outset as its point of departure, proposes equipping, in particular, the rear running wheels located on the side facing the adjacent roller ski with a brake lining laterally mounted on the running wheel, which brake lining projects slightly inwardly beyond the inner lateral boundary of the longitudinal support which extends in the direction of movement. The invention further proposes providing these lateral boundaries of the longitudinal supports with counterbrake surfaces which extend, essentially, in a direction parallel to the brake linings on the running wheels.

The brake linings on the running wheels and the counterbrake surfaces on the longitudinal supports enable the skier to execute a precisely regulated braking maneuver by causing the insides of the roller skis, when slightly offset in the direction of movement, to be pressed against each other. All that is required to achieve this effect is, somewhat similarly to downhill skiing with normal skis, with the skis being offset a little less than a foot's length, to press the roller skis against each other, the knees being held tightly together. An especially powerful braking effect results, if need be, if the skis are offset, in the direction of movement during the braking process, by a little less than the diameter of the running wheels. In this case, the brake linings which are moved in opposite directions, slide with friction on the running wheels directly against each other, which results in a particularly powerful braking action.

To enable replacement, if needed, of the brake linings or counterbrake surfaces, which are consumable parts, the invention further provides for the mounting of replaceable brake linings and/or the counterbrake surfaces on the running wheels or the inside lateral boundary of the longitudinal support.

To provide the roller ski, during the braking operation, with good stability protection against outward tilting, the invention further contemplates that each ski have one running wheel in the front and two parallel running wheels in the back, in which configuration the longitudinal support at the back end, and lying in a horizontal surface plane, is bent at a right angle to the side; and that, on the one hand, the inside, rear running wheel is positioned directly behind the heel of the ski boot in the direction of movement and, on the other, that the outer rear running wheel is in lateral, outward offset position behind the heel of the ski boot. The configuration of the running wheels also ensures that the inside running wheels will not so easily come into contact with each other during movement.

For expedience sake, the longitudinal support is also additionally bent at a downward right angle in such a way that the mounting surface of the ski boot lies beneath the axles of the running wheels. As a result of this configuration, the roller skis will always be in stable equilibrium, which fact, particularly during the braking process, when lateral forces come to bear on the roller skis, reveals itself to be a great advantage.

Figure 2:
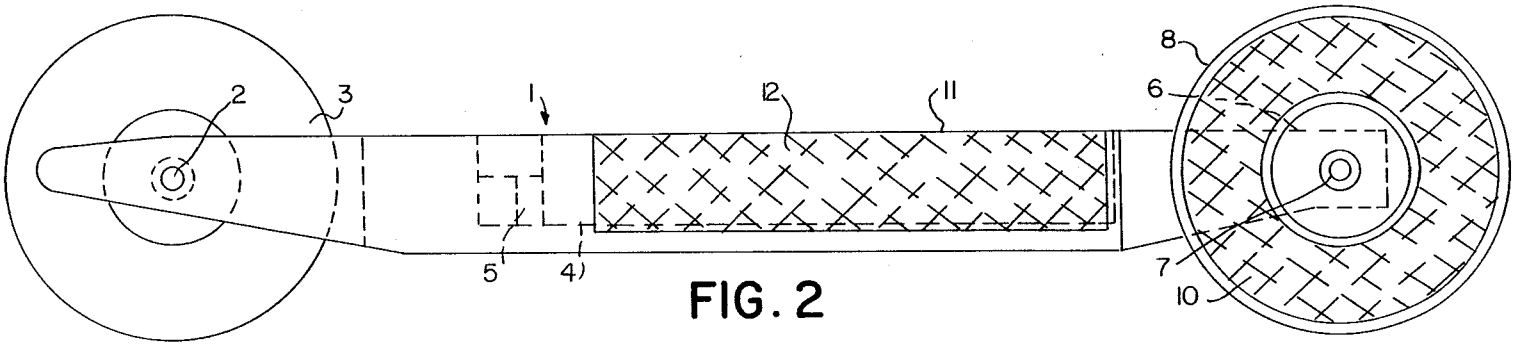

A practical example of the invention is hereinafter described in greater detail with the aid of the drawings. Shown are, in FIG. 1 a roller ski according to the invention, in a top view;

FIG. 2 a roller ski according to the invention, in side view.

In the drawing, the longitudinal support is identified by the reference number 1. The longitudinal support 1 is shaped like a fork at its front end and has a rubber-tired running wheel 3 which turns about an axle 2. The longitudinal support 1 has a tread surface 4 for a ski boot which is not shown, and which boot, by means of a binding 5, can be fastened to the longitudinal support 1 in a way well known in the art.

At the rear, the longitudinal support 1 is outwardly bent at a right angle. At this bent end 6, two rubber-tired running wheels 8 and 9, which extend parallel to each other, are attached to each other by means of an axle 7. In this configuration the running wheel located on the inside of the roller ski is positioned directly behind the heel of the ski boot, while outer, rear running wheel 9 is in lateral, outward offset position behind the heel of the ski boot.

As can be appreciated in FIG. 2, the longitudinal support 1 is bent downward at a right angle in such a way that the tread surface 4 lies beneath the axles 2 and 7 of the running wheels 3, 8 and 9. For reinforcement, the longitudinal support 1 is further provided with reinforcement ribs extending in the longitudinal direction of the support. Return catches with adjustable clamping power, which are not shown in the drawings, have been allocated to the axles 2 and 7 of the running wheels 3, 8 and 9.

According to the invention, the rear running wheel 8 on the side facing the adjacent roller ski (not shown) is equipped with a brake lining 10 which is laterally mounted on the running wheel 8, which brake lining projects slightly inwardly beyond the inner lateral boundary 11 of the longitudinal support 1 which extends in the direction of movement. The brake lining 10 is ring-shaped and is either integral with rubber tire of the running wheel 8 or glued to the side of this rubber tire, such that, if necessary, it can be replaced or exchanged. The inside lateral boundary 11 of the longitudinal support 1 is additionally provided with counterbrake surfaces 12 which extend, essentially, in a direction parallel to the brake linings 10 on the running wheels 8. These counterbrake surfaces 12 are also mounted in such a way that, if necessary, they, too, can be replaced.

Braking occurs by either pressing the brake linings 10 against the brake surfaces 12 or by pressing the brake linings 10 of the running wheels 8 directly against each other, which actions of course require that the axles of both running wheels 8 be more or less widely offset vis-a-vis each other. The braking effect increases proportional to the extent of the offset, so that the braking effect can be precisely regulated by a appropriate positioning of the feet by the skier.

I claim:

1. A pair of roller skis, each roller ski adapted to be utilized in association with a user's foot, each roller ski comprising:

(a) a longitudinal support extending in the direction of movement equipped with a binding for a ski boot and defining an inner lateral boundary of the support facing the other of said pair of roller skis;

(b) a rubber tired running wheel at the front of said longitudinal support;

(c) two parallel rubber tired running wheels at the rear of said longitudinal support, the inner rear running wheel facing the other of said pair of roller skis and arranged behind the heel of the ski boot on the longitudinal support in the direction of movement, the outer rear running wheel being laterally, outwardly offset behind the heel of the ski boot on the longitudinal support, the longitudinal support being bent at the rear therof to accommodate the two rear wheels;

(d) a brake lining laterally mounted on the inner rear running wheel projecting slightly inwardly toward the other of said pair of roller skis beyond the inner lateral boundary of the longitudinal support; and (e) a counterbrake surface provided on the inner lateral boundary of the longitudinal support extending substantially in a direction parallel to the brake lining of the rear running wheel.

2. A pair of roller skis as defined in claim 1 wherein the brake lining and the counterbrake surface are replaceable.

3. A pair of roller skis as defined in claim 1 wherein said longitudinal support includes a ski boot mounting surface and wherein said longitudinal support is so bent that the mounting surface lies below the axes of said front and rear running wheels.

* * * * *